US005346229A

United States Patent [19]

Hunter

[11] Patent Number: 5,346,229

[45] Date of Patent: Sep. 13, 1994

[54] BALANCING STICK TOY HAVING 4 EXTENDING POLES WITH LINKED CHAINS THEREON

[76] Inventor: Willie C. Hunter, 4303 Pattontown Rd., Ooltewah, Tenn. 37363

[21] Appl. No.: 26,737

[22] Filed: Mar. 5, 1993

[51] Int. Cl.[5] ..... A63B 67/00

[52] U.S. Cl. ..... 273/449; 446/396

[58] Field of Search ..... 273/449; 446/396, 240, 446/266, 264

[56] References Cited

U.S. PATENT DOCUMENTS

| | | | |
|---|---|---|---|
| 2,684,850 | 7/1954 | Williams | 446/266 X |
| 3,135,066 | 6/1964 | Scherer | 446/266 |
| 3,870,298 | 3/1975 | Varga | 273/449 |

FOREIGN PATENT DOCUMENTS

| | | | |
|---|---|---|---|
| 1046315 | 10/1966 | United Kingdom | 273/449 |

*Primary Examiner*—Danton D. DeMille

[57] ABSTRACT

A plastic stick based toy formed of injection molded plastic, and consisting of one 36 inch stick, four injection molded plastic poles which extend out from the top of the stick, evenly spaced, at 90 degree angles, and four linked chains which extend downward vertically from the ends of each of the four plastic poles. A rounded bottom is attached at the base of the stick to make the stick difficult to control when it is tilted. Four rubber tips are attached to the free ends of the four poles to prevent eye injury. The sucessful contestant is able to maintain the stick in a correct vertical balance on the tip end of the middle finger. The contestant is disqualified, however, when either of the chains touches the stick, or when the stick makes contact with any other object, or when the stick loses contact at any time with the balancing finger.

1 Claim, 2 Drawing Sheets

BALANCING STICK TOY HAVING 4 EXTENDING POLES WITH LINKED CHAINS THEREON

This invention relates to a stick based toy which is simple, fun, and challenging for both kids and adults. The Master Nerve Stick challenges the contestant's ability to master his nerves and concentration through maintaining the stick in the correct vertical balance on the tip of the finger. Whether played in competition with other contestants or enjoyed alone as a single contestant, the Master Nerve Stick offers competitive fun as each contestant attempts to conquer mind over matter by successfully controlling the stick.

BACKGROUND OF THE INVENTION

For many years kids have indulged their time in making simple and inexpensive ways to have fun and occupy their time. In times past kids have used objects like broomsticks, and baseball bats to balance on their fingers, noses, and heads to determine which kid could maintain balance of the stick for the longest period of time.

The Master Nerve Stick was born out of this past and satisfies the need for kids to have a simple, inexpensive, yet fun way to spend time with friends or play alone.

The Master Nerve Stick is a game which challenges the contestant's mental concentration. The toy is constructed of a 36" plastic stick. On the top of the stick are four(4) poles which extend out at 90 degree angles in the "east", "west", "north", and "south" directions. There are also four(4) plastic chains which hang vertically from the tip end of each of the poles.

The winner of the game is the contestant who can maintain the stick in the correct vertical balance for the longest consecutive period of time.

The four(4) plastic chains which extend downward vertically from the tip end of the corresponding four(4) poles add a degree of difficulty for the contestant. The weight of the chains in addition to the wobbling action inherant in the hollow stick tends to exaggerate any movement out of balance that the stick may make.

This game will appeal to kids because it offers a simple and fun toy to enjoy as well as an outlet for their natural competitive instincts.

This game will also appeal to executives, teachers and other adults in highly stressful occupations to relieve stress and sharpen their mental concentration.

SUMMARY OF INVENTION

The Master Nerve Stick is a toy which challenges the contestant's ability to master his nerves and mental concentration. The object of the game is for the contestant to maintain the stick in the correct vertical balance on the tip of the middle finger.

If the stick drifts out of balance in any direction, the plastic chain opposite the direction that the stick is drifting will move closer to the stick. If the plastic chain touches the stick at any time, the contestant is disqualified.

The contestant is also disqualified if the stick touches any other object such as a wall, chair . . . etc. or if the stick loses contact at any time with the balancing finger.

HOW TO WIN !!!

The contestant who can sustain the correct vertical balance of the stick for the longest consecutive time is the winner.

The toy consists of a 36" injection molded plastic stick. On top of the stick are four injection molded plastic poles which extend out from the top of the stick at 90 degree angles in the "north", "south", "east", and "west" directions. There are also four injection molded plastic linked chains which hang downward vertically from each of the corresponding poles.

The plastic chains serve to add a degree of difficulty to the game in that they intensify any movement that tilts the stick out of the correct vertical balance.

a) shows the assembly part#2, which consists of the four(4) plastic poles, the four(4) plastic linked chains, and the four(4) rubber tips.

b) shows the assembly part#1, which consists of the 36" plastic hollow stick, and the plastic rounded bottom.

DETAILED DESCRIPTION OF THE INVENTION

Figure 1:
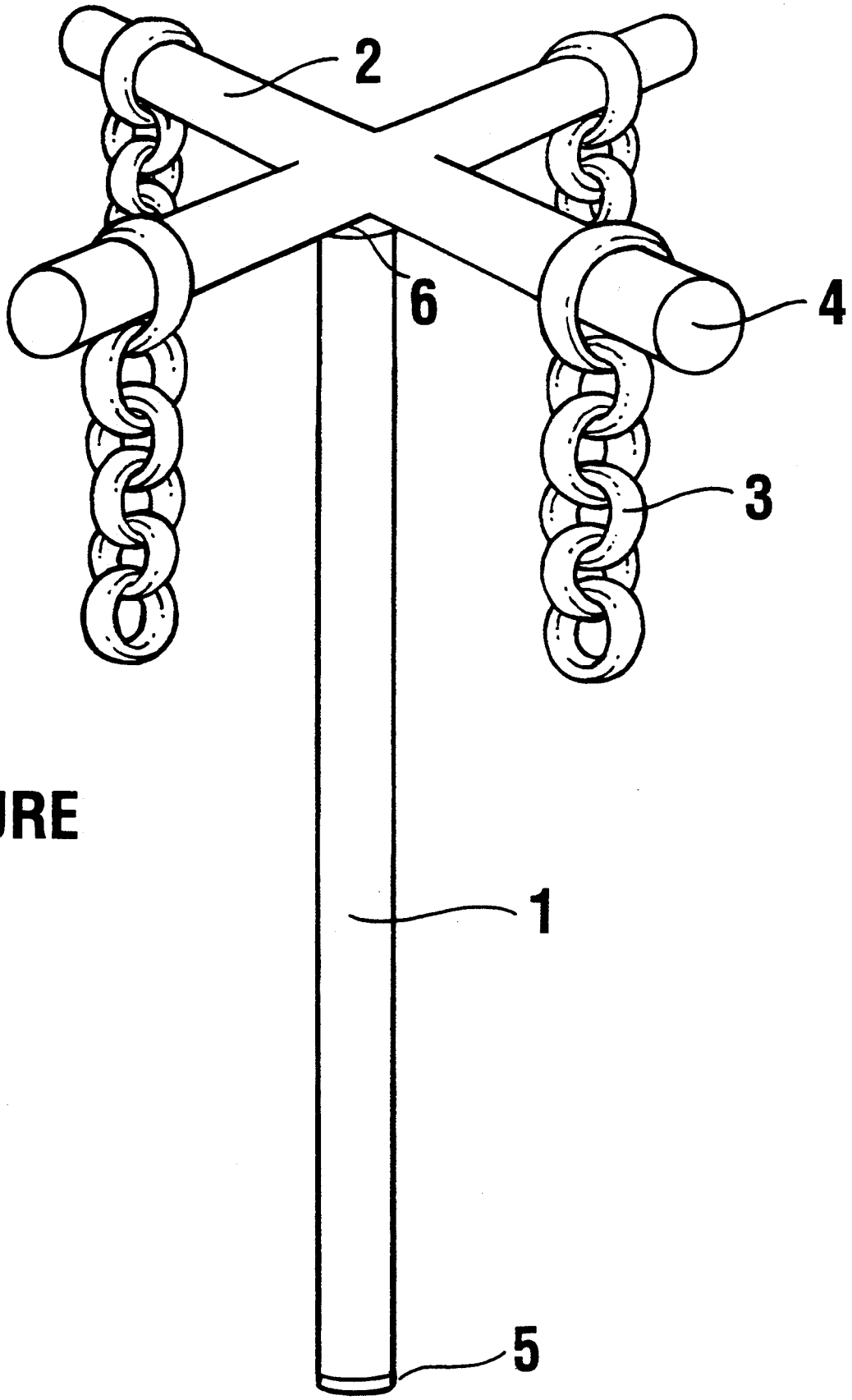
FIG. 1. Shows the side view of the Master Nerve Stick in its assembled form. The view shows the 36" plastic stick, the four(4) plastic poles, the four(4) plastic chains, the four(4) rubber tips, and the plastic rounded bottom.
Figure 2:
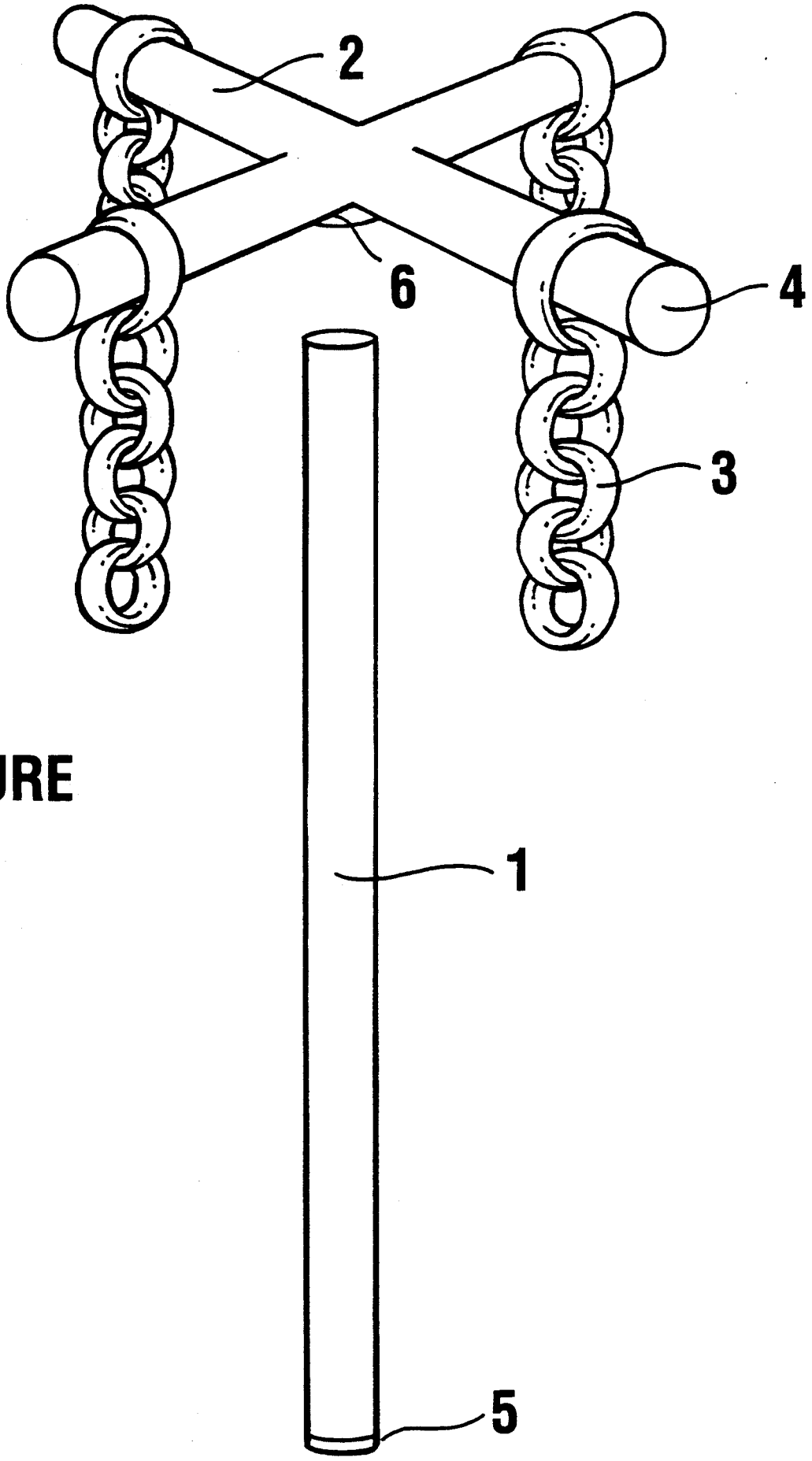
FIG. 2. Shows the side view in its unassembled form. This view shows.

Referring to the drawings, The Master Nerve Stick is shown in its assembled form in FIG. 1., and in its unassembled form in FIG. 2.

Referring to FIG. 1. and FIG. 2. The toy includes a 36" plastic injection molded hollow stick. The plastic injection molded tube used to construct the stick is hollow inside in order to facilitate a bending or waving motion when the stick is subjected to movement. This motion penalizes the contestant in that any motion which sways the stick out of balance is greatly exaggerated by the resulting wave motion and, therefore, adds a degree of difficulty for the contestant 1;

There are four(4) injection molded hollow plastic poles which extend out from the top of the stick at 90 degree angles in the "north", "south", "east", and "west" directions respectively. Each of the poles is 5 inches in length and serve to suspend their corresponding plastic chains downward vertically from the end of the poles. 2;

There are four(4) injection molded plastic linked chains, which are located at the tip end of each of their corresponding plastic poles. These chains add a level of difficulty to the toy because they serve to intensify any movement that tilts the stick out of the correct vertical position 3;

There are four(4) rubber tips which attach to the ends of each of the four plastic poles in order to prevent eye injury 4;

There is a rounded plastic bottom which adds an additional degree of difficulty to the game. When the stick is tilted at an angle out of the correct vertical position, the rounded bottom makes the stick more difficult to control 5;

There is an injection molded plastic extension located at the intersection of the four(4) "north", "south", "east", and "west" poles which extends downward vertically from the bottom of the poles. This extension is used to connect the two seperate unassembled parts. The plastic extention inserts inside the hollow plastic 36" stick in order to connect the two parts 6;

The present invention allows for a simple, yet fun toy which will appeal to kids and people of all ages. This toy has always existed in the form of balancing a broomstick or a baseball bat on the finger in many neighborhoods worldwide. The toy allows the contestant to test his/her mental concentration. It pits the contestant against his own mind, if you will, to determine if the contestant can train his mind to master his outside world, in the form of the Master Nerve Stick.

The toy can be played competitively in competition against other contestants or by a single contestant with no decrease in the level of fun. The added levels of difficulty such as the four plastic linked chains, and the rounded smooth plastic bottom only serve to make the game more challenging and fun for all the contestants involved.

Having thus described my invention, I claim:

1. A balancing toy used to test the users ability to maintain the stick in the correct vertical balance on the tip of the finger, comprising:

an injection molded, thin, hollow, plastic stick, 36" long, having top and bottom ends, the thin, hollow plastic material is such that the stick is subjected to waving or bending motion during use to add a degree of difficulty to the toy because it exaggerates any movement the stick makes when out of the correct vertical balance;

four injection molded, plastic poles, 5' long, each pole is attached at one end of the top end of the stick, extending perpendicular thereto, spaced evenly at 90 degree angles from an adjacent pole;

four injection molded, plastic linked chains, 5' long, each one is attached at the free end of each of the four poles, where the chains extend downwardly, vertically from the end of their respective plastic poles, the chains also serve to intensify any movement that tilts the stick out of the correct vertical balance;

four rubber tips each attached to the free end of each of the four poles in order to prevent eye injury;

a plastic rounded bottom attached to the bottom of the stick to add a degree of difficulty to the toy when the stick is tilted out of the correct vertical balance, the rounded bottom makes the stick difficult to control.

* * * * *